US011473391B2

(12) United States Patent
Jakkula et al.

(10) Patent No.: US 11,473,391 B2
(45) Date of Patent: Oct. 18, 2022

(54) PACKER SEALING ELEMENT WITH NON-SWELLING LAYER

(71) Applicant: Halliburton Energy Services, Inc., Houston, TX (US)

(72) Inventors: Prem Sagar Jakkula, Stavanger (NO); Geir Gjelstad, Dallas, TX (US); Vaughn Henrie Gardner, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/070,245

(22) PCT Filed: Feb. 7, 2017

(86) PCT No.: PCT/US2017/016848

§ 371 (c)(1),
(2) Date: Jul. 13, 2018

(87) PCT Pub. No.: WO2018/147833

PCT Pub. Date: Aug. 16, 2018

(65) Prior Publication Data

US 2019/0249509 A1 Aug. 15, 2019

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS 4,815,538 A * 3/1989 Burroughs ..... E21B 33/1243 166/186
7,138,470 B2 * 11/2006 Fukushi ..... C08F 214/22 526/255

(Continued)

FOREIGN PATENT DOCUMENTS

EP 2434089 3/2012
PL 294497 A1 11/1993

(Continued)

OTHER PUBLICATIONS

International Search Report and Written Opinion of PCT Application No. PCT/US2017/016848 dated Oct. 24, 2017: pp. 1-16.

*Primary Examiner* — Giovanna Wright
*Assistant Examiner* — Yanick A Akaragwe
(74) *Attorney, Agent, or Firm* — K&L Gates LLP

(57) ABSTRACT

Example apparatuses and methods are described for providing a swell packer apparatus having a vulcanized non-swelling outer layer with a pattern cut into it to expose an inner swellable sealing element. In an example embodiment, the swell packer includes a mandrel having a substantially cylindrical outer surface. A sealing element extends radially around the mandrel and a non-swelling layer circumferentially covers an outer surface of the sealing element. One or more grooves are cut in the non-swelling layer to expose a portion of the outer surface of the sealing element. The non-swelling layer is configured to prevent fluid communication between a swelling fluid disposed outside of the non-swelling layer and portions of the outer surface of the sealing element covered by the non-swelling layer.

5 Claims, 4 Drawing Sheets

(56) References Cited

U.S. PATENT DOCUMENTS

| | | | | |
|---|---|---|---|---|
| 9,869,152 | B2 | 1/2018 | Gamstedt et al. | |
| 2005/0159557 | A1 | 7/2005 | Fukushi | |
| 2007/0221387 | A1 | 9/2007 | Levy | |
| 2008/0011473 | A1 | 1/2008 | Wood et al. | |
| 2009/0178800 | A1 | 7/2009 | Korte et al. | |
| 2011/0259579 | A1 | 10/2011 | Foster et al. | |
| 2012/0073834 | A1* | 3/2012 | Lembcke | E21B 33/1208 166/387 |
| 2012/0227986 | A1 | 9/2012 | Sevre | |
| 2014/0102728 | A1 | 4/2014 | Gamstedt et al. | |
| 2015/0176365 | A1 | 6/2015 | Thorn | |
| 2015/0204159 | A1 | 7/2015 | Morehead | |
| 2016/0298400 | A1* | 10/2016 | Sabatier | E21B 43/127 |
| 2016/0312568 | A1* | 10/2016 | Anderson | E21B 33/1208 |
| 2018/0100371 | A1 | 4/2018 | Gamstedt et al. | |

FOREIGN PATENT DOCUMENTS

| | | |
|---|---|---|
| WO | 2008155564 | 12/2008 |
| WO | 2012084889 | 6/2012 |
| WO | 2014062391 | 4/2014 |
| WO | 2017151118 | 9/2017 |

* cited by examiner

PACKER SEALING ELEMENT WITH NON-SWELLING LAYER

BACKGROUND

In the drilling and completion of oil and gas wells, a borehole is drilled into subterranean producing formations. The wellbore is sometimes lined with casing to strengthen the sides of the borehole and isolate the interior of the casing from the surrounding formation. It may be desirable to selectively seal or plug the well at various locations during the production of hydrocarbons (e.g., oil and/or gas) from a well. Some completion procedures use packers, or similar devices, to provide hydraulic isolation of zones within the well for sequential operations in one zone while isolating already treated zones. For example, open-hole packers can be used to provide a seal in annular areas between concentric tubulars, such as the annular space between the earthen sidewall of the wellbore and a tubular. Similarly, cased hole packers can be used to provide an annular seal between an outer tubular (such as the wellbore casing) and an internal tubular (such as production tubing).

A common type of packer includes swell packers (also known as swellable packers), which comprise a sealing material that increases in volume and expands radially outward when a particular fluid contacts the sealing material in the well. For example, the sealing material may be constructed of a rubber compound or other suitable swellable material. The sealing material may swell in response to exposure to hydrocarbon fluids or to water in the well. The delaying and controlling of swell rates have sometimes been accomplished by fully or intermittently covering the sealing material surface with semi-permeable or non-permeable layers of barrier that are painted onto the surface of the swellable material as a coating that limits exposure of the swellable sealing material to hydrocarbon fluids/water.

DETAILED DESCRIPTION

To address some of the challenges associated with controlling the swell rates of swell packers, as well as others, apparatuses and methods are described herein that operate to provide a swell packer apparatus having a vulcanized non-swelling outer layer with a pattern cut into it to expose an inner swellable sealing element. In an example embodiment, the swell packer includes a mandrel having a substantially cylindrical outer surface. A sealing element extends radially around the mandrel and a non-swelling layer circumferentially covers an outer surface of the sealing element. One or more grooves are cut in the non-swelling layer to expose a portion of the outer surface of the sealing element. The non-swelling layer is configured to prevent fluid communication between a swelling fluid disposed outside of the non-swelling layer and portions of the outer surface of the sealing element covered by the non-swelling layer.

Figure 1:
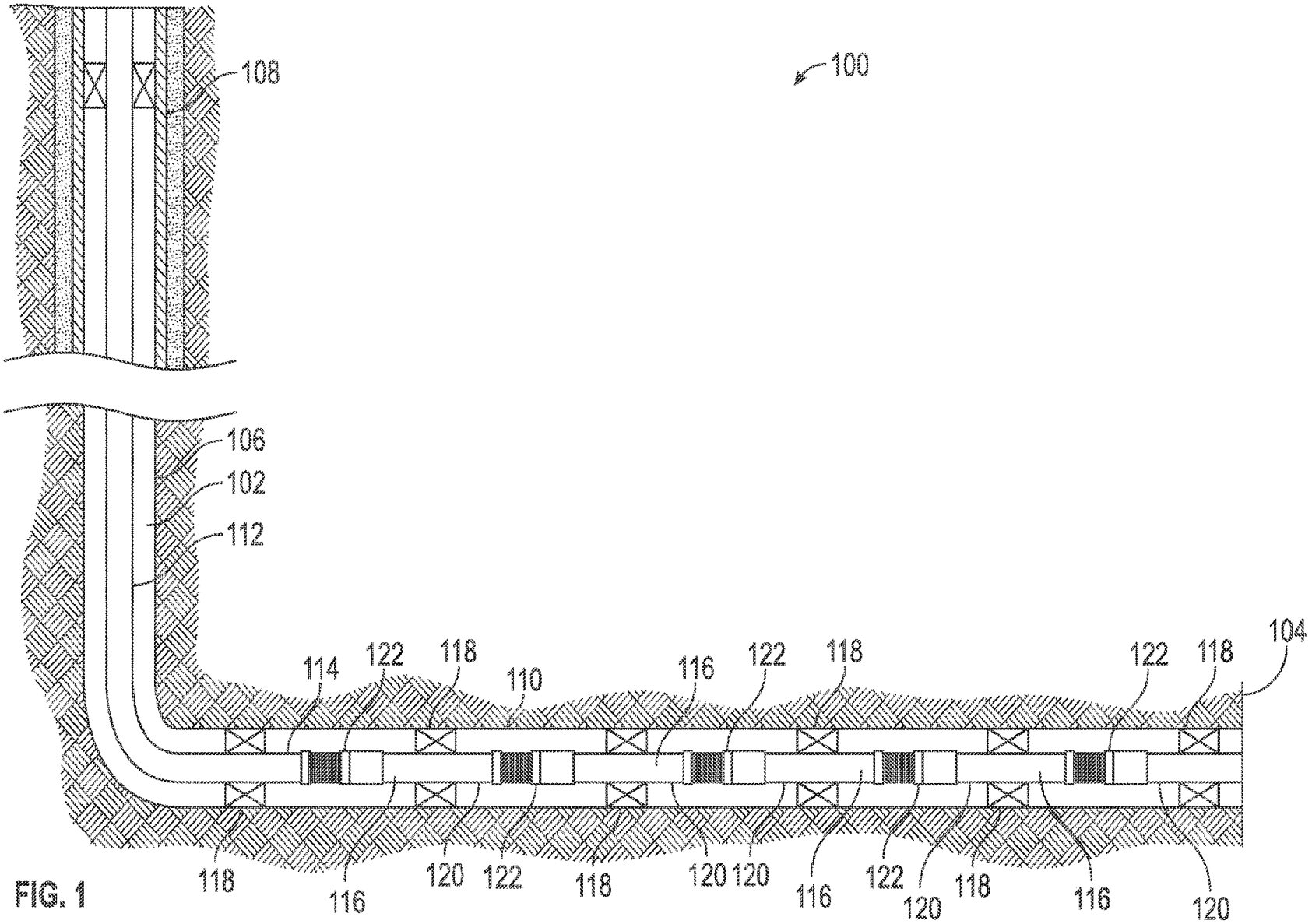
FIG. 1 is a schematic diagram illustrating an example well system, according to one or more embodiments.

FIG. 1 is a schematic diagram illustrating an example well system 100 operating environment in which swell packers may be deployed, according to one or more embodiments. In well system 100, a wellbore 102 is drilled extending through various earth formations into a formation of interest 104 for the purpose of recovering hydrocarbons, storing hydrocarbons, disposing of carbon dioxide, or the like. Those skilled in the art will readily recognize that the principles described herein are applicable to land-based, subsea-based, or sea-based operations, without departing from the scope of the disclosure. The wellbore 102 may extend substantially vertically away from the earth's surface over a vertical wellbore portion, and/or may deviate at any angle from the earth's surface over a deviated or horizontal wellbore portion. In this example well system 100, the wellbore 102 includes a substantially vertical section 106, the upper portion of which is cased by a casing string 108 that is cemented in place inside the wellbore 102. The wellbore 102 can also include substantially horizontal section 110 that extends through the formation of interest 104.

As illustrated, the horizontal section 110 of the wellbore 102 is open hole. However, those skilled in the art will readily recognize that the principles described herein are also applicable to embodiments in which the horizontal section 110 of the wellbore 102 includes borehole-lining tubing, such as casing and/or liner. Further, although FIG. 1 depicts a well having a horizontal section 110, it should be understood by those skilled in the art that this disclosure is also applicable to well systems having other directional configurations including, but not limited to, vertical wells, deviated well, slanted wells, multilateral wells, and the like.

Accordingly, it should be understood that the use of directional terms such as "above," "below," "upper," "lower," "above," "below," "left," "right," "uphole," "downhole" and the like are used in relation to the illustrative embodiments as they are depicted in the figures, the above direction being toward the top of the corresponding figure, the below direction being toward the bottom of the corresponding figure, and the uphole direction being toward the surface of the well and the downhole direction being toward the toe of the wellbore 102, even though the wellbore or portions of it may be deviated or horizontal. Correspondingly, the "transverse" or "radial" orientation shall mean the orientation perpendicular to the longitudinal or axial orientation. In the discussion which follows, generally cylindrical well, pipe and tube components are assumed unless expressed otherwise.

A tubular 112 (e.g., production tubing) extending from the surface is suspended inside the wellbore 102 for recovery of formation fluids to the earth's surface. The tubular 112 provides a conduit for formation fluids to travel from the formation of interest 104 to the surface and can also be used as a conduit for injecting fluids from the surface into the formation of interest 104. Examples of alternative tubulars include, but are not limited to, a work string, a tool string, a segmented tubing string, a jointed pipe string, a coiled tubing string, a production tubing string, a drill string, the like, or combinations thereof. In the example well system 100, tubular 112 is coupled at its lower end to a completion string 114 that has been installed in wellbore 102 and divides the horizontal section 110 into various production intervals.

The completion string 114 includes a plurality of screen joints 116 that are coupled together sequentially to form the completion string 114. Each screen joint can include a base pipe 120 and a flow control screen 122 that circumferentially surrounds at least a portion of the base pipe 120. The flow control screens 122 of the screen joints 116 operate to filter unwanted particulates and other solids from formation fluids as the formation fluids enter the completion string 114. As described herein, "formation fluids" refers to hydrocarbons, water, and any other substances in fluid form that may be produced from an earth formation.

In some embodiments, the base pipes 120 are pipe segments that include suitable connection mechanisms, such as threaded configurations, to connect each screen joint 116 to adjacent components. For example, adjacent pairs of screen joints 116 are coupled together at a screen joint connection (not shown), with the number of screen joints 116 and screen joint connections varying depending on the length of the screen joints and the wellbore in which they are deployed.

Each of the screen joints 116 are positioned between packers 118 that provide a fluidic seal between the completion string 114 and the wellbore 102, thereby defining the production intervals. The packers 118 isolate the annulus between the completion string 114 and the wellbore 102, thereby allowing formation fluid flow to enter the completion string 114 instead of flowing up the length of the casing along the exterior of the production string. The packers are designed to seal by using a sealing element (not shown) that radially expands outwards against the wellbore wall (or inner diameter of the borehole-lining tubing if present).

The sealing element in swell packers comprises a swellable material. For purposes of the disclosure herein, a swellable material may be defined as any material (e.g., a polymer, such as for example an elastomer) that swells (e.g., exhibits an increase in mass and volume) upon contact with select fluids (i.e., a swelling fluid, such as hydrocarbon fluids or water). It is to be understood that the terms polymer and/or polymeric material herein are used interchangeably and are meant to each refer to compositions comprising at least one polymerized monomer in the presence or absence of other additives traditionally included in such materials. Examples of polymeric materials suitable for use as part of the swellable material include, but are not limited to homopolymers, random, block, graft, star- and hyper-branched polyesters, copolymers thereof, derivatives thereof, or combinations thereof.

It is to be recognized that system 100 is merely exemplary in nature and various additional components can be present that have not necessarily been depicted in FIG. 1 in the interest of clarity. Non-limiting additional components that can be present include, but are not limited to, supply hoppers, valves, condensers, adapters, joints, gauges, sensors, compressors, pressure controllers, pressure sensors, flow rate controllers, flow rate sensors, temperature sensors, and the like. Such components can also include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the well system 100 generally described above and depicted in FIG. 1.

Figure 2:
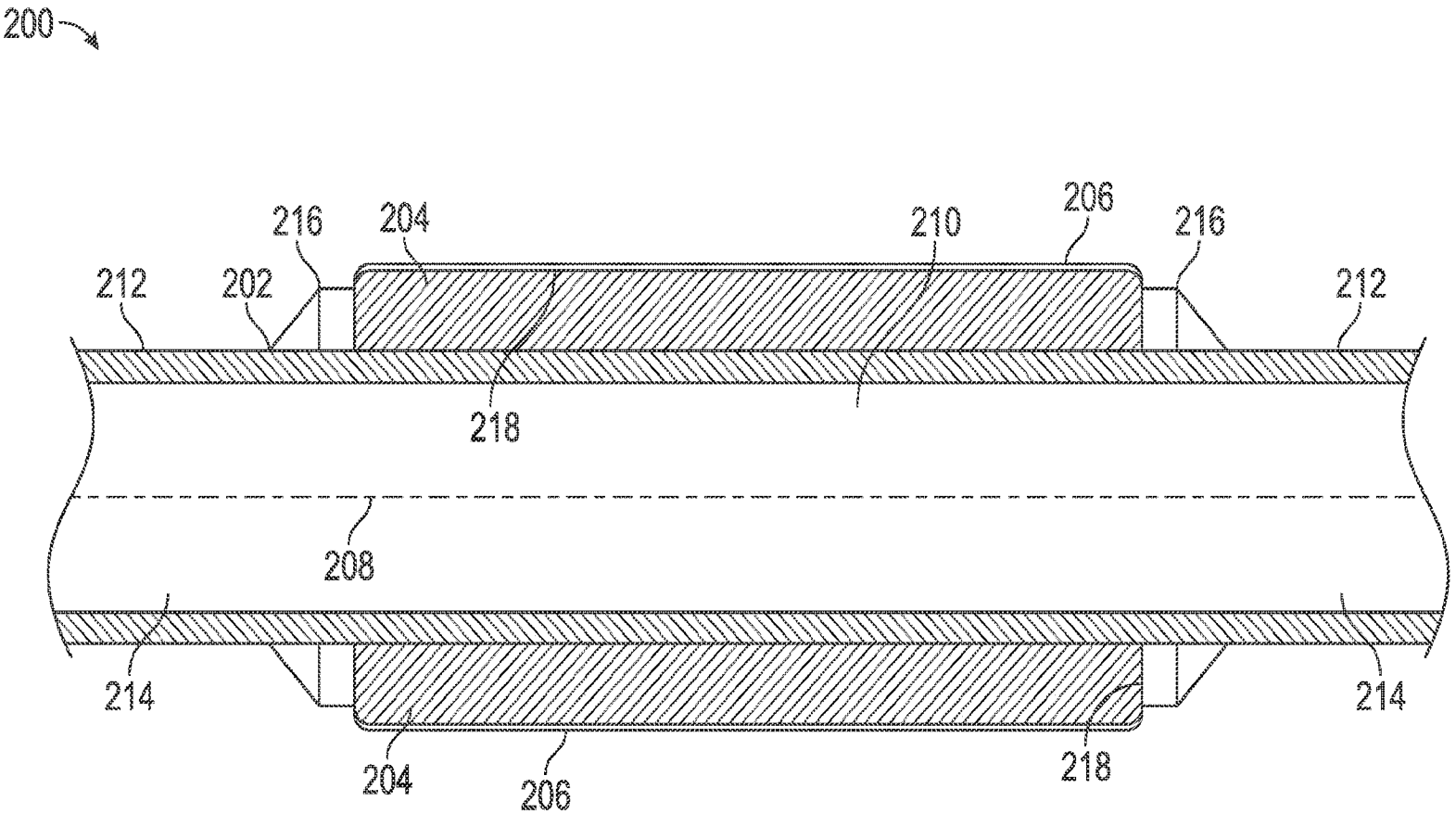
FIG. 2 is a cross-sectional view along a longitudinal axis of a packer apparatus, according to one or more embodiments.

FIG. 2 is a cross-sectional view of a packer apparatus 200, according to one or more embodiments. As shown, the packer apparatus 200 includes a mandrel 202, a sealing element 204 disposed circumferentially about/around at least a portion of the mandrel 202, and a non-swelling layer 206 covering at least a portion of the sealing element 204. For purposes of the disclosure herein, the packer apparatus 200 may be characterized with respect to a central or longitudinal axis 208 and a transverse axis that is perpendicular to the longitudinal axis 208.

In one embodiment, the mandrel 202 generally comprises a cylindrical or tubular structure or body. As shown, the mandrel 202 is co-axially aligned with the longitudinal axis of the packer apparatus 200. In some embodiments, the mandrel 202 comprises a unitary structure (e.g., a single unit of manufacture, such as a continuous length of pipe or tubing); alternatively, the mandrel 202 can comprise two or more operably connected components (e.g., two or more coupled sub-components, such as by a threaded connection). The tubular body of the mandrel 202 generally defines a continuous axial flowbore 210 that allows fluid movement through the mandrel 202.

The mandrel 202 can be configured for incorporation into a wellbore tubular 212 (e.g., such as tubular 112 or completion string 114 of FIG. 1). In such an embodiment, the mandrel 202 can include a suitable connection to the wellbore tubular 212. For example, the mandrel 202 can be incorporated within the wellbore tubular 120 such that the axial flowbore 210 of the mandrel 202 is in fluid communication with the axial flowbore 214 of the wellbore tubular 212.

In various embodiments, the packer apparatus 200 includes one or more optional retaining elements 216. Generally, the retaining elements 216 are disposed circumferentially about the mandrel 202 adjacent to and abutting the sealing element 204 on each side of the sealing element 204, as illustrated in FIG. 2. Alternatively, the retaining element 216 may be adjacent to and abutting the sealing element 204 on one side only, such as for example on a lower side of the sealing element 204, or on an upper side of the sealing element 204. The retaining element 216 prevents or limits longitudinal movement (e.g., along the central axis 208) of the sealing element 204 about the mandrel 202, while the sealing element 204 being disposed circumferentially about the mandrel 202 is placed within a wellbore and/or a subterranean formation. In some embodiment, the retaining element 216 further prevents or limits longitudinal expansion (e.g., along the central axis 208), while allowing the radial expansion, of the sealing element 204.

The sealing element 204 is generally configured to selectively seal and/or isolate two or more portions of an annular space surrounding the packer apparatus 200 (e.g., between the packer apparatus 200 and one or more walls of the wellbore and/or wellbore casing) by providing a barrier extending circumferentially around at least a portion of the exterior of the packer apparatus 200. In one embodiment, the sealing element 204 comprises a hollow cylindrical structure having an interior bore (e.g., a tube-like and/or a ring-like structure). The sealing element 204 can comprise a suitable internal diameter, a suitable external diameter, and/or a suitable thickness, for example, as may be selected by one of skill in the art in consideration of factors including, but not limited to, the size/diameter of the mandrel 202, the wall against which the sealing element 204 is configured to engage, the force with which the sealing element is configured to engage such surface(s), or other related factors. For example, the internal diameter of the sealing element 204 may be about the same as an external diameter of the mandrel 202. In an embodiment, the sealing element 204 may be in sealing contact (e.g., a fluid-tight seal) with the mandrel 202. While the embodiment of FIG. 2 illustrates a packer apparatus 200 comprising a single sealing element 204, one of skill in the art will recognize that a similar packer apparatus may comprise any other suitable number of sealing elements.

The sealing element 204 is preferably formed of a deformable elastomer, as is known in the art. For example, according to various example embodiments, the sealing element 204 includes one or more elastomeric materials such as hydrogenated nitrile butadiene rubber ("HNBR"), nitrile butadiene rubber ("NBR"), Ethylene Propylen Rubber ("EPR"), tetrafluoro ethylene/propylene copolymer rubbers ("FEPM"), fluoro-elastomers ("FKM"), neoprene, natural rubber, ("AEM") Ethylene Acrylic Rubber, ("ACM') Acrylic Esther Rubber, ("EPDM") Ethylene Propylene Diene Rubber, ("EO") Polyepichlorohydrin Homopolymer ("ECO") Polyepichlorohydrin Ethylene Oxide copolymer, ("GECO") Polyepichlorohydrin Ethylene Oxide terpolymer, ("EO/PO") Ethylene/propylene Oxide Copolymer, ("EOPO") Terapolymers, ("CR") Chloroprene, ("SBR") Styrene Rubber.

In some examples, the sealing element 204 is formed of a material that does not have a very high resistance to oil. In some examples, the sealing element 204 is formed of a water-swelling material. In at least one example, a water-swelling sealing element 204 is formed of one of the materials listed above used in conjunction with a superabsorbent. In at least one example, the superabsorbent comprises a superabsorbent polymer ("SAP") material, salt, or a combination of these.

Further, as previously discussed relative to FIG. 1, the sealing element 204 comprises a swellable material. As will be appreciated by one of skill in the art, the extent of swelling of the sealing element 204 (e.g., a swellable material) depends on a variety of factors, such as for example the downhole environmental conditions (e.g., temperature, pressure, composition of formation fluid in contact with the sealing element, specific gravity of the fluid, pH, salinity, salt type, fluid viscosity, etc.). Generally, the sealing element 204 exhibits a radial expansion (e.g., an increase in exterior diameter) upon being contacted with swelling fluids. In various embodiments, the swelling fluid may be a water-based fluid (e.g., aqueous solutions, water, etc.), an oil-based fluid (e.g., hydrocarbon fluid, oil fluid, oleaginous fluid, terpene fluid, diesel, gasoline, xylene, octane, hexane, etc.), or combinations thereof.

Other swellable materials that behave in a similar fashion with respect to oil-based fluids and/or water-based fluids may also be suitable. Those of ordinary skill in the art will be able to select an appropriate swellable material for use in the configurations of the present invention based on a variety of factors, including the application in which the composition will be used and the desired swelling characteristics. For example, some suitable swellable materials are commercially available as one or more components of the SWELL-PACKER zonal isolation system from Halliburton Energy Services, Inc.

In the embodiment of FIG. 2, the outer, non-swelling layer 206 of the packer apparatus 200 generally covers at least a portion of an outer surface 218 of the sealing element 204. The non-swelling layer 206 is substantially impermeable to swelling fluids that would cause the sealing element 204 to swell and expand. In some examples, the non-swelling layer 206 has a permeability of less than 1 md (millidarcy). In at least one example, the non-swelling layer 206 has a permeability of less than 1 μd (microdarcy). The non-swelling layer 206 can be configured to control a swell rate of the sealing element 204 (e.g., swell rate of the swellable material), wherein the swellable material of the sealing element 204 swells (e.g., expand or increase in volume) upon sufficient contact between the packer apparatus 200 and swelling fluids. For purposes of the disclosure herein, the swell rate of a material (e.g., sealing element 204, swellable material) is defined as the ratio between the volume expansion or increase of such material and the time or duration required for such volume expansion to occur; wherein the volume expansion represents the difference between a final volume assessed at the end of the evaluated time period and an initial volume assessed at the beginning of the evaluated time period. The non-swelling layer 206 can control the swell rate by limiting exposure of the swellable material (e.g., the sealing element 204) to the swelling fluid. Further, contact between the swelling fluid and the sealing element 204, and consequently the swelling of the swellable material, may be dependent upon the geometry and composition of the jacket which controls fluidic access of the swelling fluid to the sealing element 204 as described in more detail below.

In various embodiments, the non-swelling layer 206 comprises non-swellable rubber (or some other non-swellable elastomeric material) that is chemically bonded to the outer surface 218 of the sealing element 204 and provides a substantially fluid tight seal to the portions of the sealing element 204 that it covers. For example, the non-swelling layer 206 serves to prevent between a fluid (e.g., a swelling fluid) and the portion of the sealing element 204 that is covered by the non-swelling layer 206. The non-swelling layer 206 is generally impervious or impermeable with respect to swelling fluids. However, in alternative embodiments, the non-swelling layer 206 may have a low permeability with respect to the swelling fluid. In various example embodiments, the non-swelling layer 206 can include one or more elastomeric materials such as hydrogenated nitrile butadiene rubber ("HNBR"), nitrile butadiene rubber ("NBR"), perfluoro-elastomers ("FFKM"), tetrafluoro ethylene/propylene copolymer rubbers ("FEPM"), fluoro-elastomers ("FKM"), neoprene and natural rubber. In at least one example, the non-swelling layer 206 can be formed of a rubber that is non-swelling in either water or hydrocarbons.

Figure 3:
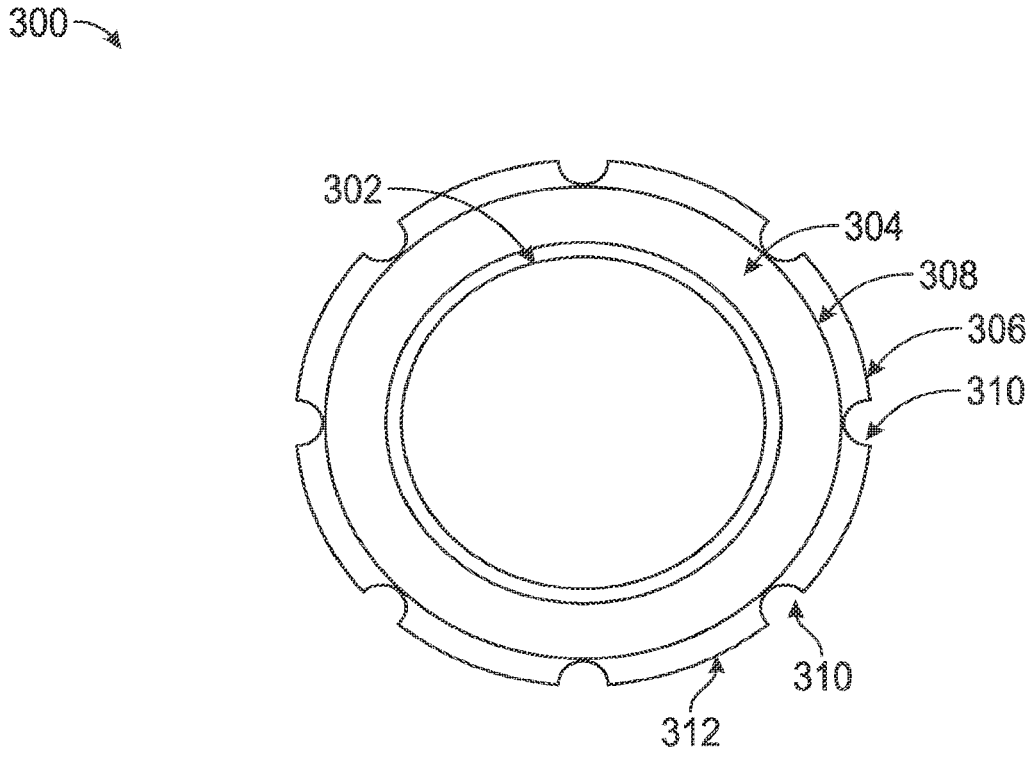
FIG. 3 is a transverse cross-sectional view of a packer apparatus, according to one or more embodiments.

Referring now to FIG. 3, illustrated is a transverse cross-sectional view of a packer apparatus 300, according to one or more embodiments. As shown, the packer apparatus 300 includes a mandrel 302, a swellable sealing element 304 disposed circumferentially around the mandrel 302, and a non-swelling layer 306 covering at least a portion of the sealing element 304. It is noted that in some embodiments, the sealing element 304 and non-swelling layer 306 can be bonded or otherwise fastened to the mandrel 302. In other embodiments, the sealing element 304 and non-swelling layer 306 can be incorporated as part of a slip-on system for use on the mandrel 302.

The mandrel 302 generally comprises a cylindrical or tubular structure or body. In some embodiments, the mandrel 302 comprises a unitary structure (e.g., a single unit of manufacture, such as a continuous length of pipe or tubing); alternatively, the mandrel 302 can comprise two or more operably connected components (e.g., two or more coupled sub-components, such as by a threaded connection). For example, the mandrel 302 can be configured for incorporation into a wellbore tubular (e.g., such as tubular 112 or completion string 114 of FIG. 1).

The swellable sealing element 304 is formed of a material that swells when exposed to a particular fluid or in response to wellbore conditions. For example, the swellable sealing element 304 can swell in volume in response to a hydrocarbon, water, or other swelling fluid or chemical. Upon contact with swelling fluids, swellable sealing element 304 swells and expands radially outward from the mandrel 302. The swellable sealing element 304 can be of a rubber compound or other material that is constructed as a unitary member or in layers.

In some embodiments, the swellable sealing element 304 comprises a rubber material that swells when exposed to hydrocarbon-based fluids. The swell rate is dependent on the chemistry of the oil and the temperature at which the exposure occurs. Oil is generally absorbed into the hydrocarbon-swellable elastomer through diffusion. Through the random thermal motion of the atoms present in liquid hydrocarbons, oil diffuses into the elastomer. Oil continues to diffuse into the elastomer causing the packing element to swell until it reaches an inside diameter of the open hole or tubular within which the packer apparatus 300 is deployed.

In other embodiments, the swellable sealing element 304 includes a material that swells when exposed to water and water-based fluids. Swell is achieved by blending water-absorbent polymers into the base elastomer compound of the swellable sealing element 304. In at least one example, salts are combined with the base elastomer to make the rubber "saltier" than the water to drive osmosis and achieve swell. In some examples, both water-absorbent polymers and salts are combined into the base elastomer. Once the packer apparatus 300 is exposed to water, the water is absorbed by the polymers, which causes the swellable sealing element 304 to radially expand outward from the mandrel 302. Similar to the hydrocarbon-swellable elastomer, a seal is created once contact with the borehole wall or wellbore casing is made.

Due to the diffusion-based absorption of swelling fluids by swellable materials, the swell rate of the sealing element 304 can be controlled by limiting exposure of swellable material (e.g., swellable sealing element 304) to swelling fluids. For example, the rate of swelling can be slowed by decreasing a surface area amount of sealing element 304 that is exposed to swelling fluids. Further, contact between swelling fluids and the sealing element 304, and consequently the swelling rate, may be dependent upon the geometry and composition of the non-swelling layer 306 which controls fluidic access of the swelling fluid to the sealing element 304 as described in more detail below.

As shown in the embodiment of FIG. 3, an outer, non-swelling layer 306 of the packer apparatus 300 generally covers at least a portion of an outer surface 308 of the sealing element 304. The non-swelling layer 306 is substantially impermeable to swelling fluids that would cause the sealing element 304 to swell and expand. In contrast to other coatings which may be painted or coated on across one or more coating procedures, the non-swelling layer 306 of the present disclosure comprises non-swellable rubber (or some other non-swellable elastomeric material) that is chemically bonded to the outer surface 308 of the sealing element 304 and provides a substantially fluid tight seal to the portions of the sealing element 304 that it covers. For example, the non-swelling layer 306 can be vulcanized onto the swellable sealing element 304 for bonding the two together.

In various embodiments, the non-swelling layer 306 is an impermeable layer of rubber (which is not reactive to well fluids) that partially prevents the reactive rubber underneath (e.g., swellable sealing element 306) from reacting with well fluids. For example, the non-swelling layer 306 serves to prevent direct contact between a fluid (e.g., a swelling fluid) and the portion of the sealing element 304 that is covered by the non-swelling layer 306. The non-swelling layer 306 is generally impervious or impermeable with respect to swelling fluids. However, in alternative embodiments, the non-swelling layer 306 may have a low permeability with respect to the swelling fluid.

Coverage of the sealing element 304 with the non-swelling layer 306 can be configured to control a swell rate of the sealing element 304, with grooves 310 (e.g., slits) formed in the outer, non-swelling layer 306 that allow swelling fluids to reach the swellable sealing element 304. The exposed portions of outer surface 308 of the sealing element 304 (e.g., which the non-swelling layer 306 is not covering due to grooves 310) will react with and allow diffusion of swelling fluids. The unexposed portions of sealing element 304 remain unreactive and do not swell until swelling fluids reach those unexposed portions via diffusion. In this way, the non-swelling layer 306 controls the swelling rate of the sealing element 304 (as swelling rate will be based on the size of grooves 310 and/or patterns in the outer non-swellable layer 306 which does not react with swelling fluids) by restricting/slowing swelling borehole fluids from reaching the portions of sealing element 304 covered by the non-swelling layer 306.

It is noted that the non-swelling layer 306 often enables the creation of an improved sealing surface against the wellbore wall or wellbore casing. Swellable materials tend to be self-lubricating, which can lead to fluid films at their outer surfaces that decrease friction and anchoring capabilities against well walls. In contrast, the non-swelling layer has a surface finish with minimal fluid films, and thus increases its anchoring capabilities due to increased friction relative to swollen sealing elements. It is further noted that the non-swelling layer 306 will not come loose from the outer surface 308 of sealing element 304 due to their chemical bonding, thereby providing a surface capable of more friction and improved sealing against the wellbore wall. In some alternative embodiments, the non-swelling layer 306 can further comprise particulates or additives (e.g., such as being embedded onto an outer surface 312 of the non-swelling layer 306) for increased friction against the wellbore wall. These additives can include, but are not limited to, sand, glass, or metallic particles of various shapes and sizes. Similarly, studs (such as those commonly found on winter tires) can be added to the outer surface 312 of the non-swelling layer 306 for increasing the grip or anchoring capacity of the packer apparatus 300.

In an embodiment, a method of making a swell packer (such as packer apparatus 300) generally comprises the steps of providing a mandrel (e.g., mandrel 302 disclosed herein) having at a sealing element (e.g., sealing element 304 disclosed herein) disposed circumferentially around the mandrel. As previously discussed, the sealing element is swellable in the presence of swelling fluids. Thus, the method includes bonding a non-swelling layer to circumferentially cover an outer surface of the sealing element. This bonding process can include chemically bonding the outer surface of the sealing element to the non-swelling layer using vulcanization or any other process that chemically bonds the two layers together.

The swelling rate of the sealing element can be controlled by cutting one or more grooves in the non-swelling layer to expose a portion of the outer surface of the sealing element. In some embodiments, the cutting of the one or more grooves comprises cutting a symmetric or an asymmetric pattern in the non-swelling layer. Other methods of controlling the swell rate include, but are not limited to, varying at least one of a pattern cut into the non-swelling layer, a surface area total of the sealing element that is exposed, and a ratio between total surface area of the non-swelling layer and the surface area total of the sealing element that is exposed. Varying the depth and width of the groove cuts can also impact the surface area of sealing element that is exposed to swelling fluids, and therefore changes swell rates. It is noted that in some embodiments, the method further comprises embedding at least one of particulates or studs on an outer surface of the non-swelling layer for enhancing anchoring capabilities of the non-swelling layer.

Figure 4:
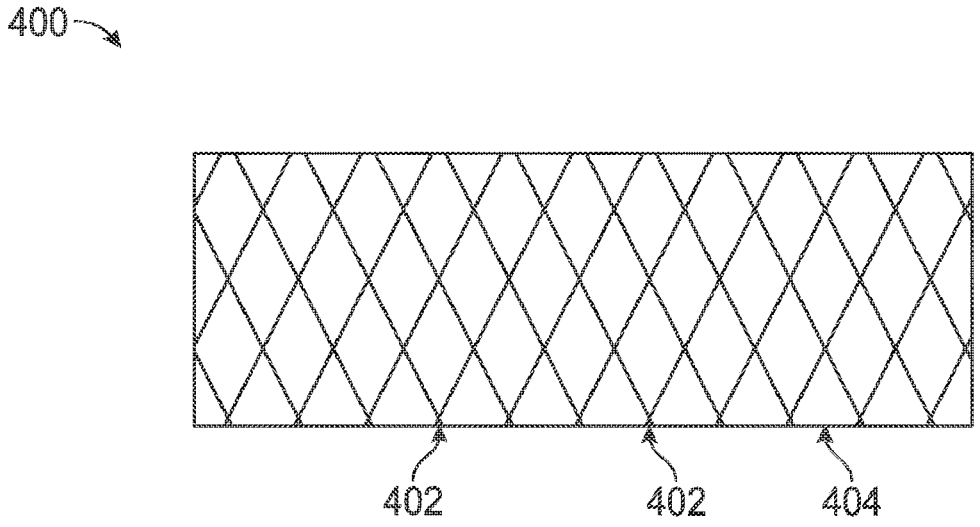
FIG. 4 illustrates a top-down view of a packer apparatus 400, according to one or more embodiments.

In various embodiments, the relationship between the exposed portion of sealing element 304 (e.g., due to grooves 310) and unexposed portions (e.g., due to coverage by outer, non-swelling layer 306) can comprise any suitable pattern, design, or the like. In one embodiment, the grooves 310 can comprise a grid-like pattern, a diamond pattern, a pattern of vertical, horizontal, and/or helical strips, a random arrangement, etc. For example, FIG. 4 illustrates a top-down view of a packer apparatus 400, according to one or more embodiments. As shown, grooves 402 are cut in the outer, non-swelling layer 404 in a diamond-shaped pattern to expose the inner, swellable sealing element. It is noted that in this example embodiment, the grooves generally encompass the entire length of packer apparatus 400.

Figure 5:
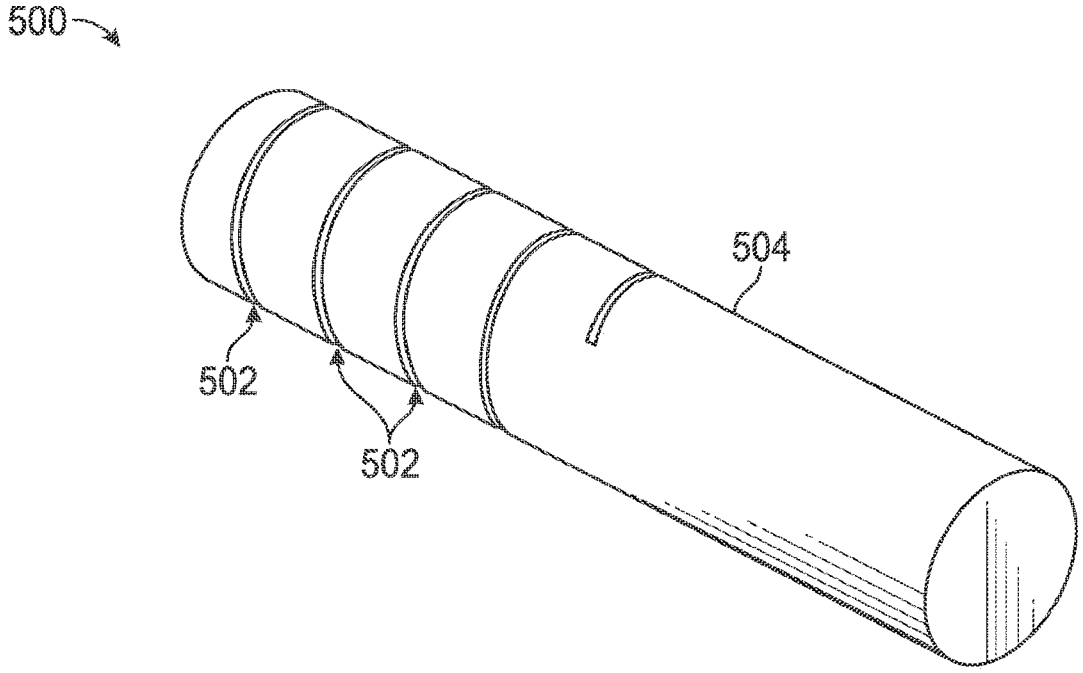
FIG. 5 is a perspective view of a packer apparatus with helical grooves, according to one or more embodiments
Figure 6:
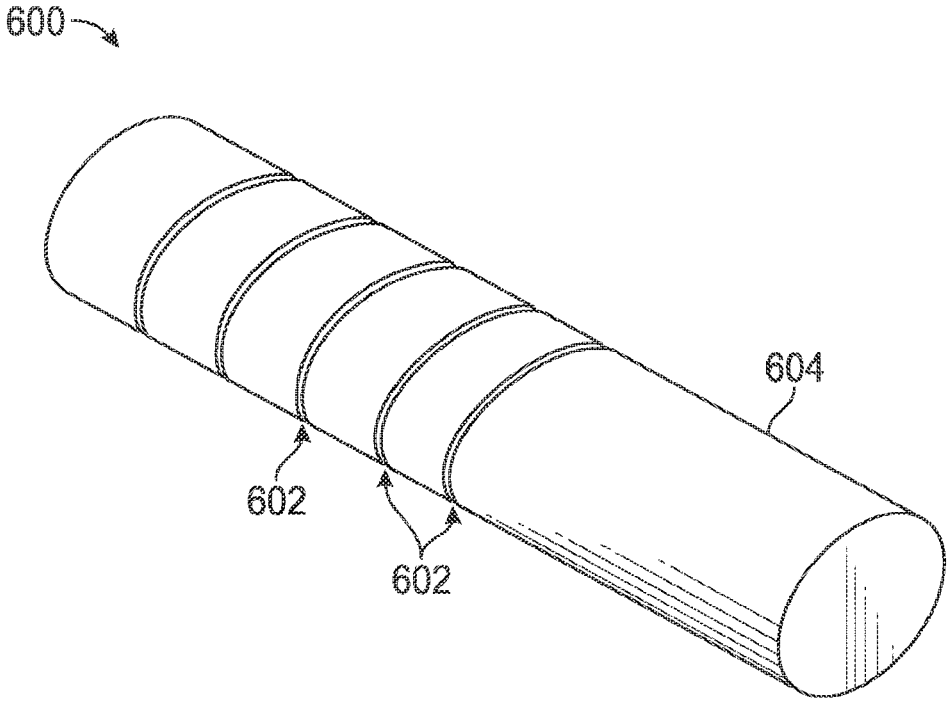
FIG. 6 is a perspective view of a packer apparatus with radial grooves, according to one or more embodiments

In other embodiments, the grooves can be cut using various linear shapes (e.g., vertical, horizontal, and/or helical stripes). For example, FIG. 5 is a perspective view of a packer apparatus 500, according to one or more embodiments. As shown, grooves 502 are cut in the outer, non-swelling layer 504 in a helical pattern to expose the inner, swellable sealing element. FIG. 6 is a perspective view of a packer apparatus 600, according to one or more embodiments. As shown, grooves 602 are cut in the outer, non-swelling layer 604 such that the grooves 602 extend circumferentially around packer apparatus 600 to expose the inner, swellable sealing element. It is noted that in the example embodiments of FIGS. 5-6, the grooves are only cut along a portion of the length of the packer apparatuses. In alternative embodiments, the grooves can instead be cut along the entire length of the packer apparatus.

In other alternative embodiments, the pattern of the grooves may also provide for any variety of opening shapes and sizes for a given surface area coverage. For example, the grooves may be cut to provide a few number of relatively large openings or a greater number of smaller openings. The openings or open areas can have any shape such as a round shape (e.g., circular, oval, or elliptical), a square or rectangular shape, linear shape (e.g., vertical, horizontal, or helical stripes), or any other suitable shape. Further, usage of not just a single pattern (e.g., the examples of FIGS. 3-6 described herein) but two or more different patterns of grooves cut into the non-swelling layer can be used to provide varying swelling characteristics (e.g., linear swelling rates, non-linear swelling rates, and various combinations thereof). The disclosure provided herein is applicable to the removal of the barrier non-swelling layer (e.g, via the cutting of grooves) in any pattern, and starting or stopping at any point along the packer apparatus' length or circumference.

In various embodiments, the swell rate of a swell packer can be advantageously controlled (e.g., modulated) by varying the composition of the swelling material; the exposed surface area of the sealing element; a pattern cut into the non-swelling layer; a surface area total of the sealing element that is exposed, and a ratio between total surface area of the non-swelling layer and the surface area total of the sealing element that is exposed; or any combinations thereof. As will be appreciated by one of skill in the art, the larger the ratio between total surface area of the non-swelling layer and the surface area total of the sealing element that is exposed, the higher the value of the swell rate (e.g., the sealing element will swell faster or at a faster rate). Similarly, as will be appreciated by one of skill in the art, the smaller the ratio between total surface area of the non-swelling layer and the surface area total of the sealing element that is exposed, the smaller the value of the swell-rate (e.g., the sealing element will swell slower or at a slower rate).

Many advantages can be gained by implementing the apparatuses and methods described herein. For example, the non-swelling rubber described herein provides an outer layer with improved grip properties in open hole or cased wells. In some embodiments, the grooves in the outer non-swell rubber might also operate to create a suction or vacuum area between the swelling rubber and the wellbore wall or casing, thereby providing improved grip properties. In other embodiments, the non-swelling layer can further contain particulates that provide more enhanced friction and anchoring force against the wellbore wall, and can increase the differential pressure rating of packer elements.

The outer layer of non-swelling rubber can have any possible symmetric or asymmetric patterns, which allows changes to the surface area of inner swell rubber that is exposed to swelling fluid. This allows the delay or control of swell rate based on area exposure (while avoiding the usage of barriers or coatings) and avoids any comprises to swell rubber integrity. Additionally, encasing the swellable material of the seal element (e.g., the swell rubber) within the non-swelling layer reduces its extrusion, reducing the need for anti-extrusion end rings.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

Although specific embodiments have been illustrated and described herein, it will be appreciated by those of ordinary skill in the art that any arrangement that is calculated to achieve the same purpose may be substituted for the specific embodiments shown. Various embodiments use permutations or combinations of embodiments described herein.

The following numbered examples are illustrative embodiments in accordance with various aspects of the present disclosure.

1. A packer apparatus may include a mandrel having a substantially cylindrical outer surface; a sealing element extending radially around the mandrel; and a non-swelling layer that circumferentially covers an outer surface of the sealing element, in which one or more grooves are cut in the non-swelling layer to expose a portion of the outer surface of the sealing element, and in which the non-swelling layer is configured to prevent fluid communication between a swelling fluid disposed outside of the non-swelling layer and portions of the outer surface of the sealing element covered by the non-swelling layer.

2. The packer apparatus of example 1, in which the non-swelling layer is chemically bonded to the outer surface of the sealing element.

3. The packer apparatus of any of the preceding examples, in which the sealing element is swellable in the presence of swelling fluids.

4. The packer apparatus of any of the preceding examples, in which coverage of the sealing element with the non-swelling layer is configurable to control a swell rate of the sealing element.

5. The packer apparatus of any of the preceding examples, in which the swell rate increases as a ratio between a surface area total of the sealing element that is exposed and a total surface area of the non-swelling layer increases.

6. The packer apparatus of any of the preceding examples, in which the one or more grooves includes a pattern that is cut into the non-swelling layer to expose underlying portions of the sealing element.

7. The packer apparatus of any of the preceding examples, in which the non-swelling layer further includes particulates embedded onto an outer surface of the non-swelling layer for increasing friction when the packer apparatus is activated.

8. A system may include a production tubing within a wellbore, in which the wellbore is encased with wellbore casing; and a packer apparatus deployed along the production tubing, in which the packer apparatus includes: a mandrel having a substantially cylindrical outer surface; a sealing element extending radially around the mandrel; and a non-swelling layer that circumferentially covers an outer surface of the sealing element, in which one or more grooves are cut in the non-swelling layer to expose a portion of the outer surface of the sealing element, and in which the non-swelling layer is configured to prevent fluid communication between a swelling fluid disposed outside of the non-swelling layer and portions of the outer surface of the sealing element covered by the non-swelling layer.

9. The system of example 8, in which the non-swelling layer is chemically bonded to the outer surface of the sealing element.

10. The system of any of the preceding examples, in which the sealing element is swellable in the presence of swelling fluids.

11. The system of any of the preceding examples, in which coverage of the sealing element with the non-swelling layer is configurable to control a swell rate of the sealing element.

12. The system of any of the preceding examples, in which the swell rate increases as a ratio between a surface area total of the sealing element that is exposed and a total surface area of the non-swelling layer increases.

13. The system of any of the preceding examples, in which the one or more grooves includes a pattern that is cut into the non-swelling layer to expose underlying portions of the sealing element.

14. The system of any of the preceding examples, in which the pattern includes at least one of a grid-like pattern, a diamond pattern, a pattern of vertical, horizontal, and helical strips.

15. The system of any of the preceding examples, in which the non-swelling layer further includes particulates embedded onto an outer surface of the non-swelling layer for increasing friction when the packer apparatus is activated.

16. A method may include providing a mandrel having a sealing element disposed circumferentially about the mandrel, in which the sealing element is swellable in the presence of swelling fluids; bonding a non-swelling layer to circumferentially cover an outer surface of the sealing element; and cutting one or more grooves in the non-swelling layer to expose a portion of the outer surface of the sealing element.

17. The method of example 16, in which bonding the non-swelling layer includes chemically bonding the outer surface of the sealing element to the non-swelling layer using vulcanization.

18. The method of any of examples 16-17, in which cutting one or more grooves includes cutting a symmetric or an asymmetric pattern in the non-swelling layer.

19. The method of any of examples 16-18, further including: embedding at least one of particulates or studs on an outer surface of the non-swelling layer for enhancing anchoring capabilities of the non-swelling layer.

20. The method of any of examples 16-19, further including: controlling a swell rate of the sealing element by varying at least one a pattern cut into the non-swelling layer, a surface area total of the sealing element that is exposed, and a ratio between total surface area of the non-swelling layer and the surface area total of the sealing element that is exposed.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

What is claimed is:

1. A method, comprising:

providing a mandrel having a sealing element disposed circumferentially about the mandrel, wherein the sealing element is swellable in the presence of swelling fluids and comprises a cylindrical outer surface;

chemically bonding a non-swelling layer to circumferentially cover the entire cylindrical outer surface of the sealing element so as to prevent fluid communication with the cylindrical outer surface of the sealing element from outside the non-swelling layer; and cutting one or more grooves into an external diameter of the non-swelling layer to expose a portion of the cylindrical outer surface of the sealing element to the outside of the non-swelling layer.

2. The method of claim 1, wherein chemically bonding the non-swelling layer comprises vulcanization.

3. The method of claim 1, wherein cutting one or more grooves comprises cutting a symmetric or an asymmetric pattern in the non-swelling layer.

4. The method of claim 1, further comprising embedding at least one of particulates or studs on an outer surface of the non-swelling layer for enhancing anchoring capabilities of the non-swelling layer.

5. The method of claim 1, further comprising controlling a swell rate of the sealing element by varying at least one of a pattern cut into the non-swelling layer or a surface area total of the sealing element that is exposed.

* * * * *